US005540333A

United States Patent [19]

Gonzalez et al.

[11] Patent Number: 5,540,333

[45] Date of Patent: Jul. 30, 1996

[54] DUAL BAGS FOR FRENCH FRIES AND KETCHUP

[76] Inventors: Anthony L. Gonzalez; Rose A. Gonzalez, both of 8828 Parkridge Dr., Oklahoma City, Okla. 73132

[21] Appl. No.: 381,415

[22] Filed: Jan. 30, 1995

[51] Int. Cl.[6] ..... B65D 5/4805

[52] U.S. Cl. ..... 206/541; 229/110; 229/117.01; 229/400; 229/904; 294/55; 383/38; 426/120

[58] Field of Search ..... D7/691; 206/216, 206/541, 542, 546; 229/117.03, 117.06, 400, 404, 902–904, 117.01, 110; 294/55; 383/38–40; 426/119, 120

[56] References Cited

U.S. PATENT DOCUMENTS

| | | | |
|---|---|---|---|
| 405,413 | 6/1889 | Hicks | 229/117.06 |
| 3,442,435 | 5/1969 | Ludder et al. | 229/904 |
| 4,180,111 | 12/1979 | Davis | 383/40 |
| 4,718,595 | 1/1988 | Jones | 229/400 |
| 4,854,466 | 8/1989 | Lane, Sr. | 294/55 |
| 4,955,528 | 9/1990 | Schluckebier | 229/902 |
| 5,137,210 | 8/1992 | Hibbs | 229/400 |
| 5,417,364 | 5/1995 | Shaw | 229/904 |

FOREIGN PATENT DOCUMENTS

| | | | |
|---|---|---|---|
| 642389 | 10/1993 | Australia | 229/904 |
| 2068244 | 11/1993 | Canada | 229/904 |

*Primary Examiner*—Jimmy G. Foster

[57] ABSTRACT

Dual bags including a primary bag for french fries coupled to a secondary bag for ketchup. The primary bag has a base, a front wall and a rear wall. The base is formed with side edges coming to an obtuse angle at an intermediate point. Glue-receiving strips extend outwardly from the side edges. Each wall has interior fold lines flaring outwardly and supplemental fold lines located laterally outwardly from the interior fold lines. Glue-receiving strips are located outwardly from the supplemental fold lines. The upper edge of the central extent of the front wall has a concaved curve and the upper edge of the central extent of the rear wall has a convex curve. The smaller secondary ketchup bag has a rectangular outer panel and a rectangular inner panel with a transverse fold line therebetween adapted to create a V-shape cross section when open for receiving ketchup. The outer panel has a first interior V-shaped panel located on opposite sides thereof, with a supplemental V-shaped panel located on opposite sides of the interior V-shaped panels and with rectangular glue-receiving strips on opposite sides of the intermediate V-shaped panels.

1 Claim, 3 Drawing Sheets

FIG. 3
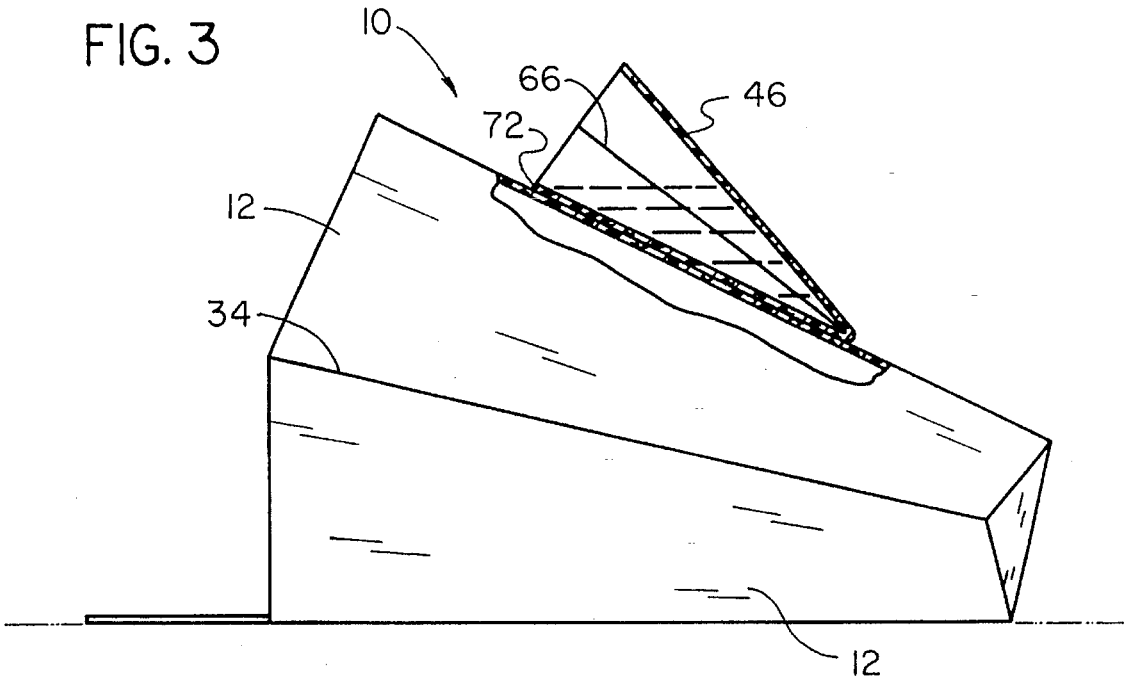
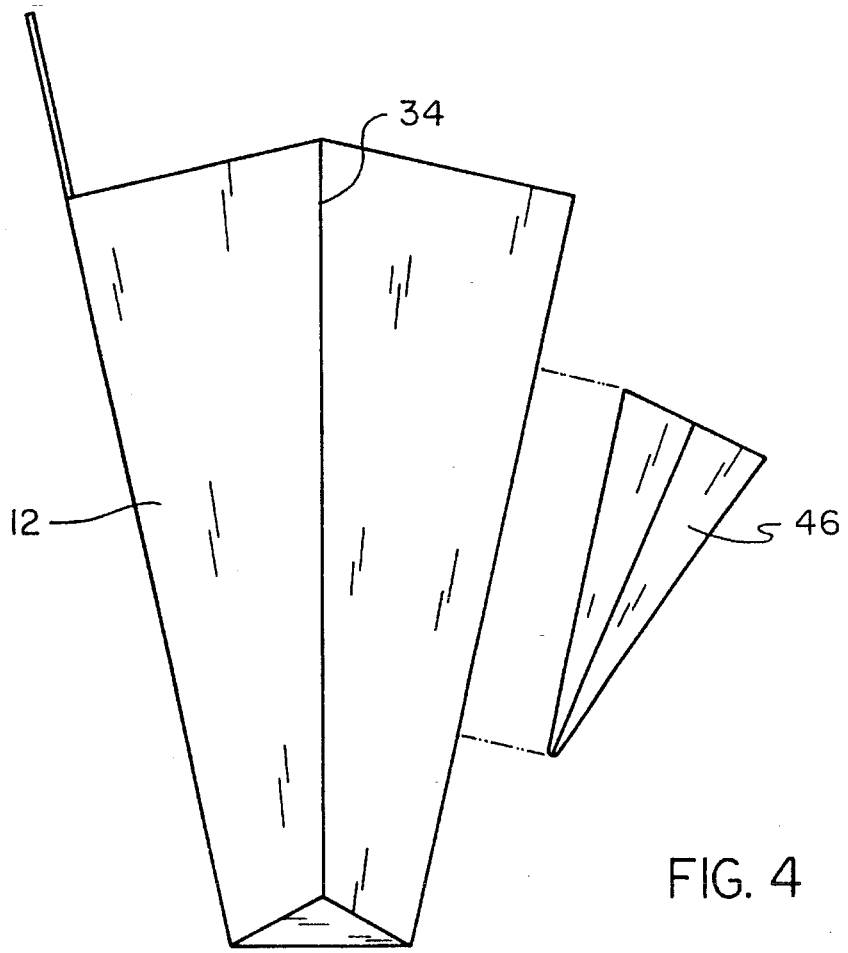
FIG. 4

DUAL BAGS FOR FRENCH FRIES AND KETCHUP

BACKGROUND OF THE INVENTION

1. Field of the Invention

The present invention relates to dual bags for french fries and ketchup and more particularly pertains to supporting ketchup in a small bag attached to a larger french fry bag.

2. Description of the Prior Art

The use of bags for carrying various foods and the like is known in the prior art. More specifically, bags for carrying various foods and the like heretofore devised and utilized for the purpose of carrying one or more types of food in bags are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,161,732 to Clein a fold-out carton and blank therefor.

U.S. Pat. No. 4,915,235 to Roosa discloses a tear panel french fry carton.

U.S. Pat. No. 4,877,178 to Eisman discloses a paperboard foldable carton.

U.S. Pat. No. 4,714,190 to Morrocco a fast food take out carton with cover.

U.S. Pat. No. Des. 306,975 to Brondyke the design of a french fry holder.

In this respect, the dual bags for french fries and ketchup according to the present invention substantially departs from the conventional concepts and designs of the prior art, and in doing so provides an apparatus primarily developed for the purpose of supporting ketchup in a small bag attached to a larger bag.

Therefore, it can be appreciated that there exists a continuing need for new and improved dual bags for french fries and ketchup which can be used for supporting ketchup in a small bag attached to a larger french fry bag. In this regard, the present invention substantially fulfills this need.

SUMMARY OF THE INVENTION

In view of the foregoing disadvantages inherent in the known types of bags for carrying various foods and the like now present in the prior art, the present invention provides an improved dual bags for french fries and ketchup. As such, the general purpose of the present invention, which will be described subsequently in greater detail, is to provide a new and improved dual bags for french fries and ketchup and method which has all the advantages of the prior art and none of the disadvantages.

To attain this, the present invention essentially comprises of dual bags for french fries and ketchup comprising, in combination a large primary french fry bag formed of paper and having a base and a front wall and a rear wall, the base being formed with parallel front and rear edges and side edges coming to an obtuse angle at an intermediate point and having glue-receiving strips extending outwardly from the side edges, the walls each having a bottom transverse fold line at the base and interior fold lines flaring outwardly from the ends of the bottom fold line with supplemental fold lines located laterally outwardly from the interior fold lines with glue-receiving strips located outwardly therefrom, the upper edge of the central extent of the front wall having a concaved curve and the upper edge of the central extent of the rear wall having a convex curve. A smaller secondary ketchup bag rectangular outer panel and a rectangular inner panel with a transverse fold line therebetween adapted to create a V-shape cross section when open for receiving ketchup, the major outer panel having a first interior V-shaped panel located on opposite sides thereof, with a supplemental V-shaped panel located on opposite sides of the interior V-shaped panels with rectangular glue-receiving strips on opposite sides of the intermediate V-shaped panels coupled together, with fold lines separating the inner and outer panels, the interior V-shaped panel and the outer panel, the interior and supplemental V-shaped panels and the supplemental V-shaped panels and the glue-receiving strips. An adhesive coupling together the glue-receiving strips for attachment to the associated portion of the bag and further adhesive for coupling the exterior surface of the front face of the primary bag with the adjacent face of the secondary bag.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved dual bags for french fries and ketchup which have all the advantages of the prior art bags for carrying various foods and the like and none of the disadvantages.

It is another object of the present invention to provide new and improved dual bags for french fries and ketchup which may be easily and efficiently manufactured and marketed.

It is further object of the present invention to provide new and improved dual bags for french fries and ketchup which are of durable and reliable constructions.

An even further object of the present invention is to provide new and improved dual bags for french fries and ketchup which are susceptible of a low cost of manufacture with regard to both materials and labor, and which accordingly are then susceptible of low prices of sale to the consuming public, thereby making such dual bags for french fries and ketchup economically available to the buying public.

Still yet another object of the present invention is to provide new and improved dual bags for french fries and ketchup which provide in the apparatuses and methods of the prior art some of the advantages thereof, while simultaneously overcoming some of the disadvantages normally associated therewith.

Still another object of the present invention is for supporting ketchup in a small bag attached to a larger bag containing french fries.

Lastly, it is an object of the present invention to provide new and improved dual ketchup bags comprising of a primary bag having a base and a front wall and a rear wall, the base being formed with parallel front and rear edges and side edges coming to an obtuse angle at an intermediate point and having glue-receiving strips extending outwardly from the side edges, the walls each having a bottom transverse fold line at the base and interior fold lines flaring outwardly from the ends of the bottom fold line with supplemental fold lines located laterally outwardly from the interior fold lines with glue-receiving strips located outwardly therefrom, the upper edge of the central extent of the front wall having a concaved curve and the upper edge of the central extent of the rear wall having a convex curve. A smaller secondary ketchup bag rectangular outer panel and a rectangular inner panel with a transverse fold line therebetween adapted to create a V-shape cross section when open for receiving ketchup, the major outer panel having a first interior V-shaped panel located on opposite sides thereof, with a supplemental V-shaped panel located on opposite sides of the interior V-shaped panels with rectangular glue-receiving strips on opposite sides of the intermediate V-shaped panels coupled together, with fold lines separating the inner and outer panels, the interior V-shaped panel and the outer panel, the interior and supplemental V-shaped panels and the supplemental V-shaped panels and the glue-receiving strips. A smaller bag formed of paper for supporting ketchup, the smaller bag being formed of a central outer rectangular panel and a rectangular inner panel with a fold line therebetween adapted to create a V-shape cross section when open for receiving ketchup, the major outer panel having a first interior V-shaped panel on opposite sides of the major panel and having a supplemental V-shaped panel located exteriorly of the intermediate V-shaped panel and having laterally exterior thereof rectangular glue supporting panels adapted to be coupled to the interior panel when coupled together, with fold lines separating the primary panel with the adjacent primary triangular panel and between the primary and secondary panel and between the secondary panel and the adhesive receiving sheet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevational view of the dual bag of FIG. 1 in an expanded orientation with a secondary bag shown in cross-sections.

FIG. 4 is an exploded side-elevational view of the dual bag of FIGS. 1 and 3.

The same reference numerals refer to the same parts through the various Figures.

DESCRIPTION OF THE PREFERRED EMBODIMENT

Figure 1:
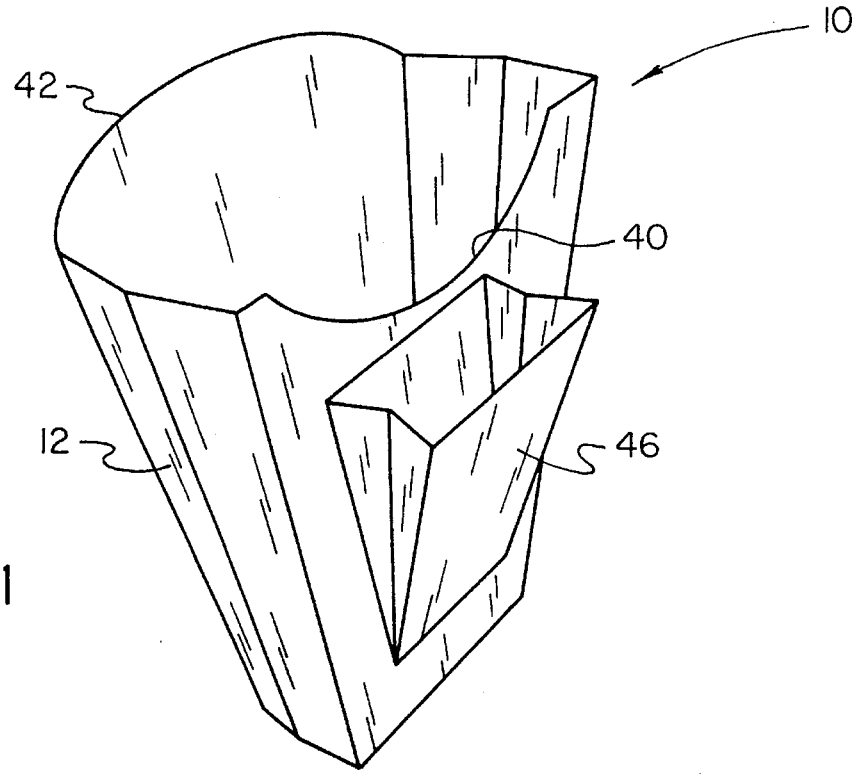
FIG. 1 is a perspective illustration of the preferred embodiment of the new and improved dual bags for french fries and ketchup constructed in accordance with the principles of the present invention.
Figure 2:
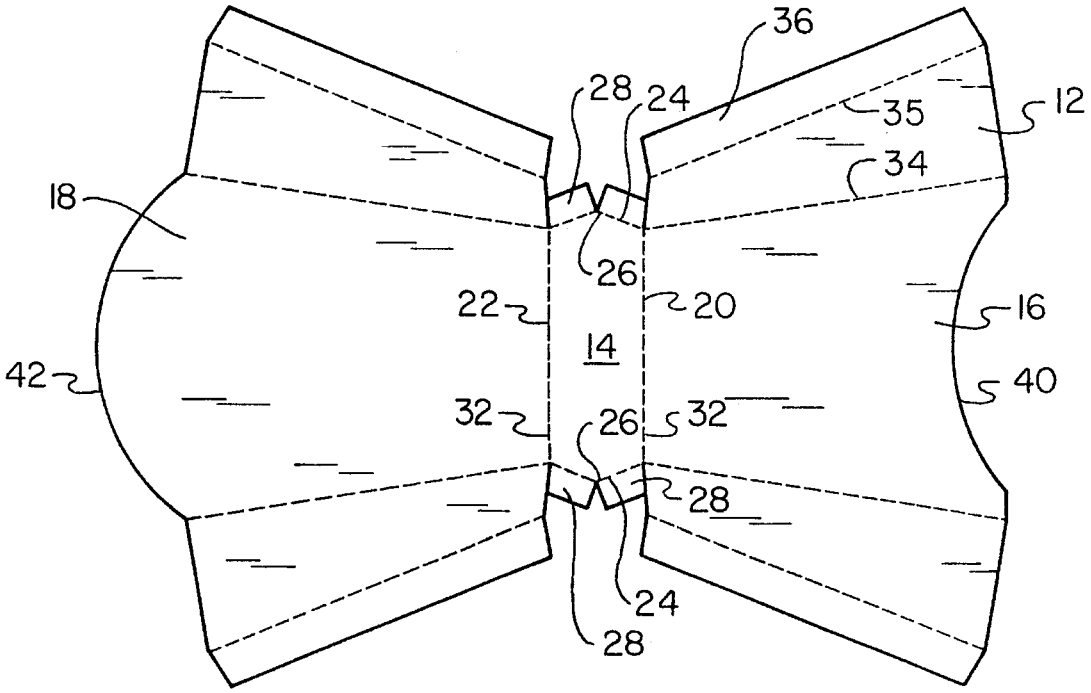
FIG. 2 is a plan view of the paper to be folded so as to form the primary bag.
Figure 5:
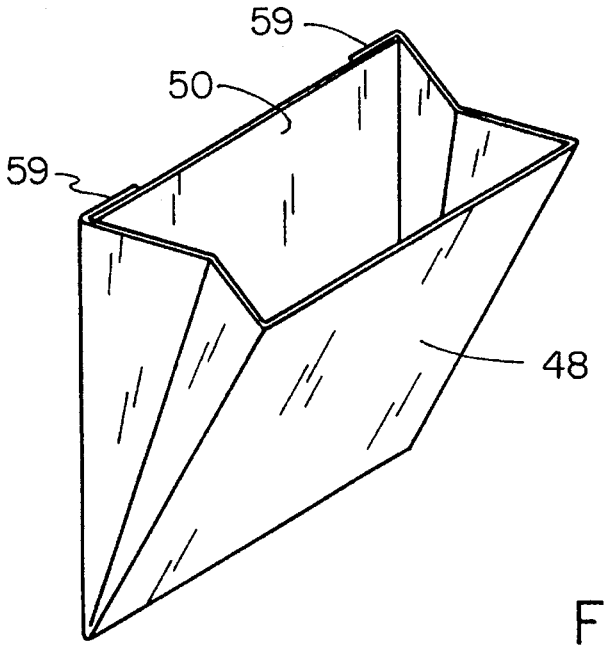
FIG. 5 is a perspective view of the secondary bag of the prior Figures shown in an expanded condition.
Figure 6:
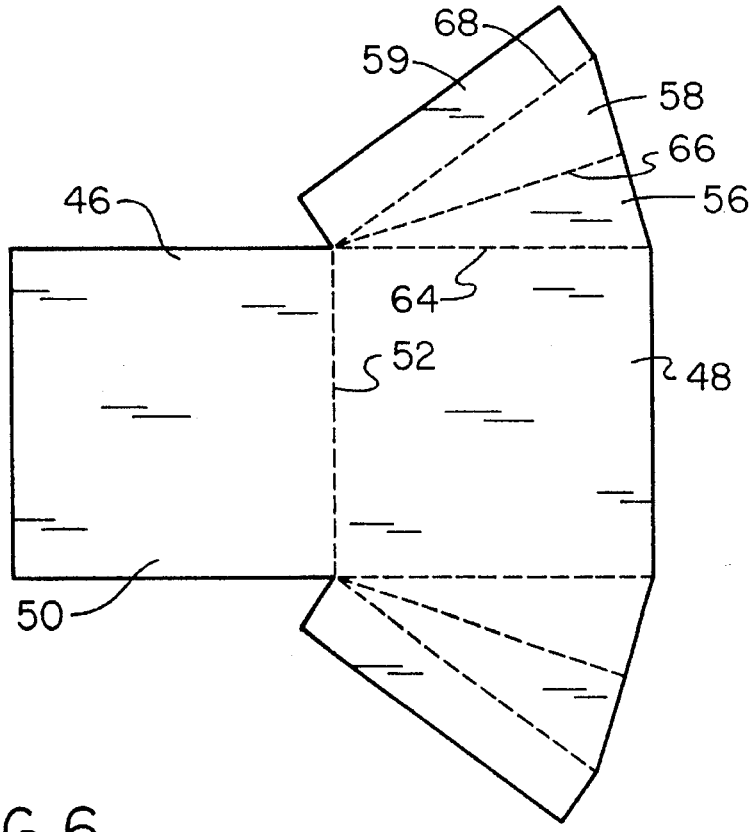
FIG. 6 is a plan view of the paper utilized to form the secondary bag of the prior Figure.

With reference now to the drawings, and in particular to FIG. 1 thereof, the preferred embodiment of the new and improved dual bags for french fries and ketchup embodying the principles and concepts of the present invention and generally designated by the reference numeral 10 will be described.

The invention, the new and improved dual bags for french fries and ketchup is comprised of a plurality of components. In their broadest context, such components include a primary french fry bag, a secondary ketchup bag, and adhesive for forming the bags and coupling the bags to each other. Such components are specifically configured and correlated with respect to each other so as to attain the desired objective.

More specifically, the central component of the system 10 of the present invention is a large primary french fry bag 12. Such primary bag 12 is formed of paper. It should be understood, however, other flexible disposable materials, preferably biodegradable, could readily be utilized. The primary bag is formed with a base 14. The base has a front wall 16 and a rear wall 18. Such base has parallel front and rear edges 20 and 22. As well as side edges 24. The side edges come to an obtuse angle at an intermediate point 26. In addition, glue-receiving strips 28. Such strips extend outwardly from the side edges of the base.

A pair of walls are then provided, a front wall and a rear wall 16 and 18. The walls each have a bottom transverse fold line 32. Located at the base for separation therebetween. Each wall also has interior fold lines 34. Such fold lines flare outwardly from the ends of the bottom fold line. Supplemental fold lines are located laterally outward from the interior fold lines 35. Supplemental glue-receiving strips 36 are located laterally outward therefrom.

To facilitate the positioning of french fries in the bag and the removal of such french fries thereof, the upper edge of the central extent of the front wall has a concaved curve 40. Corresponding thereto, the upper edge of the central extent of the rear wall has a convex curve 42.

The next major component of the system 10 is a small secondary ketchup bag 46. The secondary ketchup bag, like the primary french fry bag, is formed of paper. It should be understood, however, other flexible disposable materials, preferably biodegradable, could readily be utilized. The secondary bag is formed with a rectangular outer panel 48 and a rectangular inner panel 50. A transverse fold line 52 is located therebetween. The bag is adapted to be folded upon such fold line to create a V-shaped cross-section when opened for receiving ketchup.

The outer panel has a first interior V-shaped panel 56 located on opposite sides thereof. A supplemental V-shaped panel 58 is located on the opposite sides of the interior V-shaped panel. In addition, rectangular glue-receiving strips 59 are located on opposite sides of the intermediate V-shaped panels. The glue-receiving strips are adapted to be coupled to the interior panel when the portions of the bag are coupled together for bag assembly.

In order to facilitate the coupling of the various components of the secondary bag, there are provided fold lines 52 separating the inner and outer panels. Additional fold lines 64 separate the interior V-shaped panel and the outer panel. Further supplemental fold lines 66 separate the interior and supplemental V-shaped panels. Lastly, the supplemental V-shaped panels and the glue-receiving strips 59 are separated by yet further fold lines 68.

The last component of the system is the adhesive 72. The adhesive is located on the various glue-receiving strips. In this manner, when the component material for the primary bag and the secondary bag are folded and positioned for operation and use, such adhesive will hold together such bags in their proper orientation. In addition, the adhesive is also provided in the region between the central extent of the front wall of the primary bag and the central extent of the rear face of the secondary bag for coupling the secondary bag to the primary bag. Compare FIGS. 4 and 3.

The dual bags for french fries and ketchup works by unfolding or popping out the cup bonded to the french fry container. Its whole purpose is to eliminate messy ketchup spills.

The dual bags for french fries and ketchup also eliminates the need for foil pouches usually given to you at fast food restaurants. The dual bags for french fries and ketchup would also help the environment by eliminating the amount of foil used in excess at these restaurants.

The cup pops out and is ready to be filled with condiments. There is no need to squirt condiments over ordinary french fry containers, covering food items and creating a mess or a spill.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved dual bags for french fries and ketchup comprising, in combination:

a large primary french fry bag formed of paper and having a base and a front wall and a rear wall, the base being formed with parallel front and rear edges and side edges coming to an obtuse angle at an intermediate point and having glue-receiving strips extending outwardly from the side edges, the walls each having a bottom transverse fold line at the base and interior fold lines flaring outwardly from the ends of the bottom fold line with supplemental fold lines located laterally outwardly from the interior fold lines with glue-receiving strips located outwardly therefrom, the upper edge of the central extent of the front wall having a concaved curve and the upper edge of the central extent of the rear wall having a convex curve; and a smaller secondary ketchup bag having a rectangular outer panel and a rectangular inner panel with a transverse fold line therebetween adapted to create a V-shape cross section when open for receiving ketchup, the inner and outer panels having a first interior V-shaped panel located on opposite sides thereof, with a supplemental V-shaped panel located on opposite sides of the interior V-shaped panels with rectangular glue-receiving strips on opposite sides of the interior V-shaped panels, with, each interior V-shaped panel and the outer panel being coupled together, respective interior and supplemental V-shaped panels being coupled together, and respective supplemental V-shaped panels and glue-receiving strips of the secondary bag being coupled together; and an adhesive coupling together the glue-receiving strips of said primary bag, for attachment to an associated portion of the primary bag, and further adhesive for coupling an exterior surface of a front face of the primary bag with the secondary bag.

* * * * *